US008801510B2

(12) United States Patent
Howery

(10) Patent No.: US 8,801,510 B2
(45) Date of Patent: Aug. 12, 2014

(54) INFLATABLE VENTILATION LIFE CURTAIN

(75) Inventor: Rodney Howery, Cedar Bluff, VA (US)

(73) Assignee: Heintzmann Corporation (USA), Cedar Bluff, VA (US)

( * ) Notice: Subject to any disclaimer, the term of this patent is extended or adjusted under 35 U.S.C. 154(b) by 1735 days.

(21) Appl. No.: 11/686,760

(22) Filed: Mar. 15, 2007

(65) Prior Publication Data

US 2007/0218825 A1 Sep. 20, 2007

Related U.S. Application Data

(60) Provisional application No. 60/782,543, filed on Mar. 16, 2006.

(51) Int. Cl.
*E21F 1/14* (2006.01)

(52) U.S. Cl.
USPC ..... 454/170

(58) Field of Classification Search
CPC ..... E21F 1/14
USPC ..... 454/170
See application file for complete search history.

(56) References Cited

U.S. PATENT DOCUMENTS

| | | | | |
|---|---|---|---|---|
| 1,766,324 | A | 6/1930 | Berner | |
| 3,831,318 | A | 8/1974 | Richmond | |
| 3,863,554 | A | 2/1975 | Boyd | |
| 4,023,372 | A | 5/1977 | Presler et al. | |
| 4,036,024 | A | 7/1977 | Dreker et al. | |
| 4,056,939 | A | 11/1977 | Alvarez-Calderon | |
| 4,102,138 | A | 7/1978 | Dreker et al. | |
| 4,465,405 | A | 8/1984 | Durrfeld | |
| 4,807,405 | A * | 2/1989 | Borgquist | 52/2.18 |
| 5,469,920 | A | 11/1995 | Conti et al. | |
| 6,082,828 | A | 7/2000 | Bailey et al. | |

* cited by examiner

*Primary Examiner* — Kang Hu
*Assistant Examiner* — Samantha Miller
(74) *Attorney, Agent, or Firm* — Sughrue Mion, PLLC

(57) ABSTRACT

An inflatable ventilation curtain includes a curtain portion and an inflatable portion provided around a perimeter of the curtain portion. The inflatable portion includes an inner layer and an outer layer attached together, wherein the inner layer is provided immediately adjacent to the perimeter of the curtain portion and wherein the outer layer is provided around at least a part of an outer perimeter of the inner layer, thereby providing two distinct inflatable areas.

13 Claims, 8 Drawing Sheets

INFLATABLE VENTILATION LIFE CURTAIN

CROSS REFERENCE TO RELATED APPLICATIONS

This application claims benefit of U.S. Provisional Application No. 60/782,543 filed Mar. 16, 2006; the entire disclosure of which is incorporated herein by reference.

FIELD OF THE INVENTION

The present invention relates generally to mine ventilation control, and more specifically, is directed to an inflatable ventilation curtain, and method of use thereof, for providing a temporary ventilation diversion. Such a ventilation curtain is useful in emergency mining conditions, as well as everyday use.

BACKGROUND OF THE INVENTION

As recently witnessed in underground mining, once a disruption of the ventilation system occurs, restoration of the ventilation is very critical for mine workers. Moreover, having the ability to sufficiently construct or repair the ventilation disruption quickly will enhance the effectiveness of the entire ventilation system. Such quick response is required in several situations, such as mine rescue and barricading.

The present invention expedites the ventilation construction in such emergency conditions, so that reliable air ventilation can be achieved more quickly and easily than in currently used devices, such as line curtains. In addition, the present invention is also useful for everyday use.

Currently, tents or line curtains are used in the event of fire or explosion to provide a temporary ventilation diversion. In the event of such an emergency, reliable air ventilation is critical for workers trapped in the mine. In particular, a line curtain is used to seal off a contained area for the workers. The line curtains are manually attached to the floors and walls of the mine, so that the workers can be secured in a safe environment. The line curtains isolate a physical area within the mine to maintain healthy air quality for the workers until they can be rescued or make a safe escape.

However, these line curtains are cumbersome to use, since the workers must manually attach the edges of the curtains to the walls, floors and ribs. Hammers, nails, boards, roof bolts, crib blocks, etc. are required to secure the line curtains. This is labor intensive and time consuming, and certainly not ideal in emergency conditions. In addition, it is very difficult to get a tight seal, and thus, air quality is compromised.

SUMMARY OF THE INVENTION

Illustrative, non-limiting exemplary embodiments of the present invention overcome the above disadvantages, and other disadvantages not described above.

The present invention provides an inflatable ventilation curtain which is installed quickly and easily. Such an inflatable ventilation curtain provides a tight seal to achieve a proper air quality in a contained environment.

An apparatus consistent with the present invention includes an inflatable ventilation curtain having a curtain portion and an inflatable portion provided around a perimeter of the curtain portion. The inflatable portion includes an inner layer and an outer layer attached together, wherein the inner layer is provided immediately adjacent to the perimeter of the curtain portion and wherein the outer layer is provided around at least a part of an outer perimeter of the inner layer, thereby providing two distinct inflatable areas.

In addition, the inner layer and the outer layer are gas inflatable.

Alternatively, wherein the inner layer is gas inflatable and the outer layer is foam filled.

According to one aspect of the invention, the inflatable portion is integrally provided with the curtain portion.

Additionally, when inflated, the inflatable portion has a thicker width, as viewed in cross-section, than the curtain portion.

The invention may further provide at least one valve between the inner layer and the outer layer to facilitate the inflation of the outer layer via the inner layer. When three valves are provided between the inner layer and the outer layer, they may be disposed at the top and sides of the inner layer.

Still further, the inner layer includes at least two support columns connecting the top and bottom sides of the inner layer, and substantially parallel with the sides of the inner layer.

The invention may further include an inflate/deflate valve provided on the inner layer for inflating the inflating portion.

Still further, a door is provided on the curtain portion for facilitating entry and exit.

To create a barricading situation, a plurality of inflatable ventilation curtains may be provided to surround a designated area.

According to yet another aspect of the invention, a method of setting up an inflatable ventilation curtain which has a curtain portion and an inflatable portion provided at a periphery of the curtain portion, includes spreading out the inflatable ventilation curtain in a predetermined area; raising sides of the inflatable ventilation curtain with raising means; and inflating the inflatable portion.

The inner layer completely inflates before the outer layer begins to inflate.

The inner layer may also include support columns extending between top and bottom sides of the inner layer, and all portions of the inner layer including the support columns inflate at substantially the same time.

BRIEF DESCRIPTION OF THE DRAWINGS

The above and/or other aspects and advantages of the present invention will become apparent and more readily appreciated from the following description of the exemplary embodiments, taken in conjunction with the accompanying drawings of which.

DETAILED DESCRIPTION OF THE INVENTION

Figure 1A:
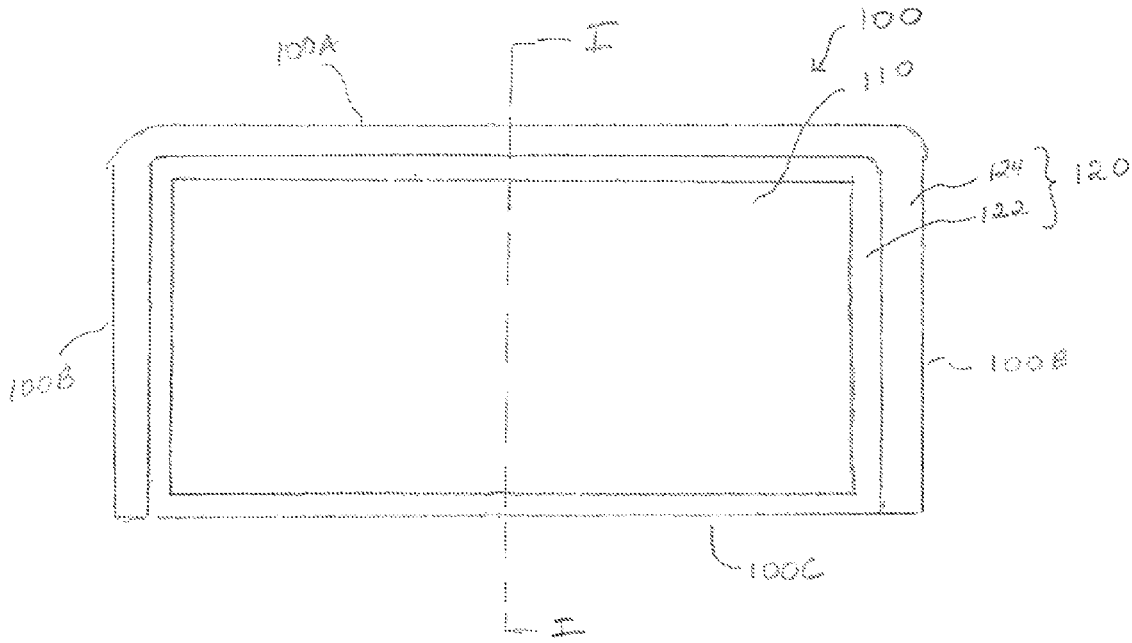
FIG. 1A is an exemplary embodiment of the inflatable ventilation life curtain after inflation.

Reference will now be made in detail to the exemplary embodiments of the present invention, examples of which are illustrated in the accompanying drawings, wherein like reference numerals refer to like elements throughout.

Figure 1B:
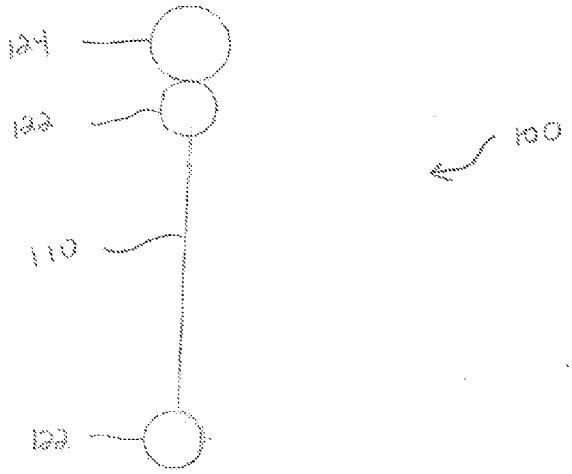
FIG. 1B is a cross-sectional view along lines I-I of FIG. 1.

FIG. 1A illustrates an exemplary embodiment of the present invention, wherein an inflatable ventilation life curtain 100 includes a curtain portion 110 and an inflatable portion 120 disposed around the perimeter of the curtain portion 110. FIG. 1B illustrates the inflatable ventilation life curtain 100 along section I-I of FIG. 1A.

The curtain portion 110 is surrounded on the two sides, bottom and top, when viewed in the direction of FIG. 1A, by the inflatable portion 120. That is, for purposes of illustration and explanation, the top side of the inflatable ventilation life curtain is 100A, the sides of the inflatable ventilation life curtain are 100B, and the bottom of the inflatable ventilation life curtain is 100C. The top, sides and bottom notations apply to the inflatable portion and curtain portion as well. The inflatable portion 120 comprises an inner layer 122 and an outer layer 124, wherein the inner layer 122 is disposed immediately adjacent to the curtain portion 110, whereas the outer layer 124 is disposed adjacent to the inner layer 122.

While the inner layer 122 is disposed around the entire perimeter of the curtain portion 110, i.e., two sides, top and bottom, the outer layer 124 is only disposed on the two sides and top.

The inner layer 122 has a smaller diameter than the outer layer 124, however, the present invention is not limited to this structure. Preferably, the inner layer 122 has a diameter of about 8 inches, and the outer layer 124 has a diameter of 12-16 inches.

The curtain portion 110 is a thin layer of fabric, and this portion does not inflate. Thus, the inflatable portion 120, when inflated, has a thicker cross-section than the curtain portion 110 (FIG. 1B).

Figure 2:
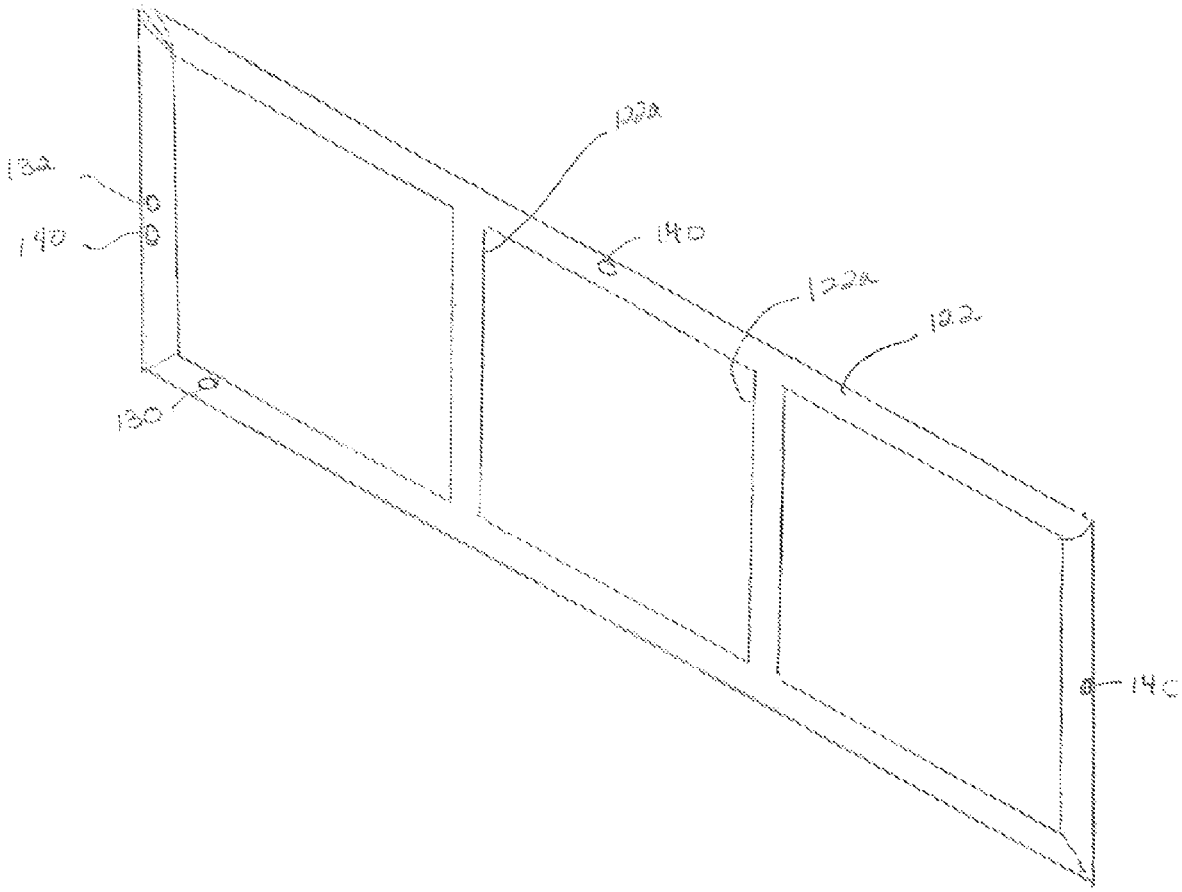
FIG. 2 illustrates the inner layer of the inflatable portion of the invention.

FIG. 2 provides a more detailed view of the inner layer 122. The inner layer 122 provides a structural support to the inflatable ventilation life curtain 100. As shown in this exemplary embodiment, the inner layer 122 may include additional support columns 122*a*. These support columns 122*a* are fabricated in the same manner as the other portions of the inner layer 122, and three panels 110*a*, 110*b*, 110*c* (see FIG. 5) of the curtain portion 110 are provided therebetween.

This inner layer 122, also known as a support frame, inflates before the outer layer 124, also known as a sealing bladder. Thus, this support frame (including the support columns if provided) becomes completely inflated thereby imparting structure to the inflatable ventilation life curtain 100 before the sealing bladder begins to inflate.

Two inflate/deflate valves 130, 132 are provided on the inner layer 122 to allow for it to inflate. A first inflate/deflate valve 130 is generally used for automatic inflation via a carbon dioxide ($CO_2$) canister, or the like. A second inflate/deflate valve 132 is generally used for manually inflating the device if necessary.

In addition, three pressure relief valves (PRV) 140 are provided on the inner layer 122, along the sides and top. The PRVs 140 allow air to flow from the inner layer 122 to the outer layer 124 of the inflatable portion 120 in an even manner. Thus, once the inner layer 122 is completely inflated, the outer layer 124 begins to inflate via the PRVs 140.

Figure 3:
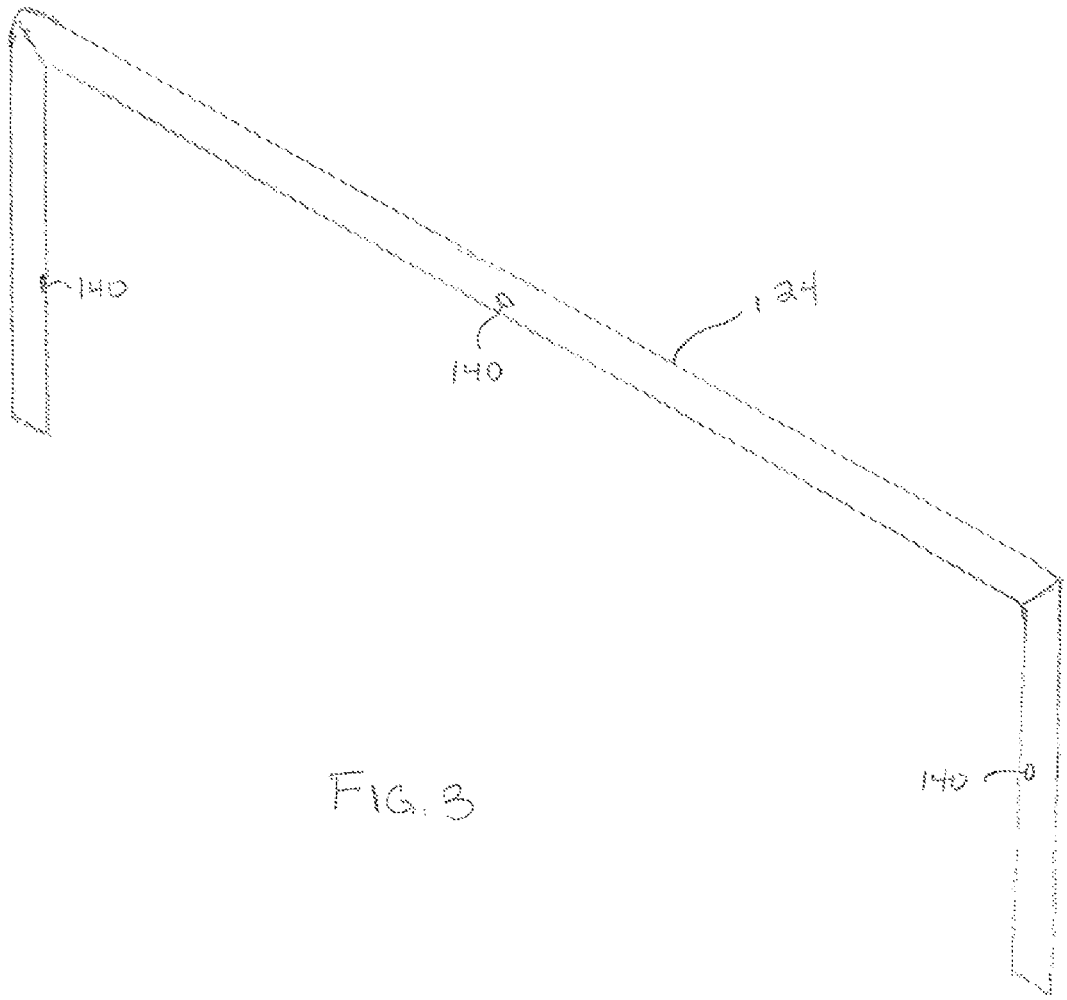
FIG. 3 illustrates the outer layer of the inflatable portion of the invention.

The outer layer 124 of the inflatable portion is shown in FIG. 3. Here, the outer layer 124 has three sides so as to surround three sides of the curtain portion 110. The outer layer 124 is not disposed on the bottom side in this exemplary embodiment. However, the invention is not limited to this structure and thus, the outer layer 124 could be provided on the bottom side also.

The PRVs 140 are illustrated also on the outer layer 124. As discussed above, the PRVs 140 connect the airway between the inner and outer layers 122, 124, thus, allowing for the air to enter the outer layer 124 from the inner layer 122 via the PRVs.

Since the air can only move through the PRVs 140 one way, the air pressure is maintained in the inner layer 122 even if the outer layer 124 is compromised and there is a leak.

Figure 4A:
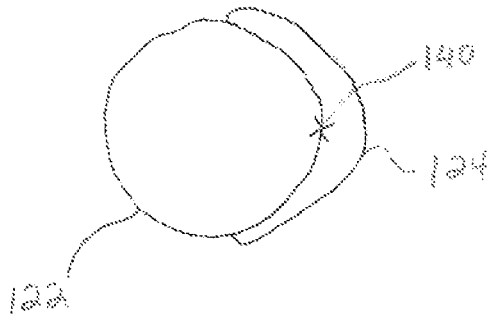
FIGS. 4A and 4B illustrate the inner and outer layers of the inflatable portion during various phases of inflation.
Figure 4B:
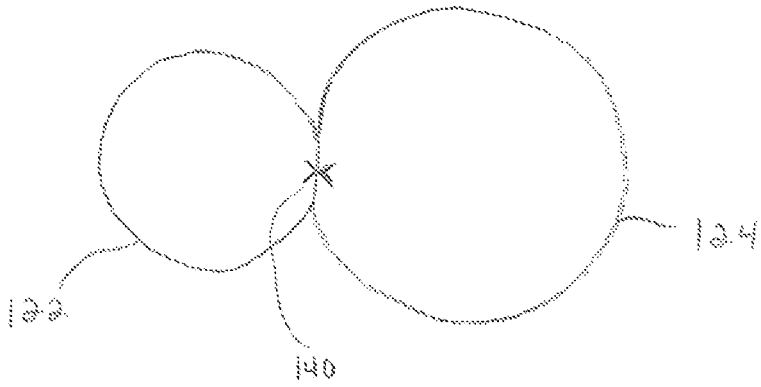

FIGS. 4A and 4B provide a more detailed view of the relationship between the inner and outer layers 122, 124 of the inflatable portion 120. FIG. 4A shows the structure at a time when the inner layer 122 has been at least partially inflated, but the outer layer 124 has not yet been inflated. FIG. 4B shows the structure when both the inner and outer layers 122, 124 have been inflated.

The inner and outer layers 122, 124 can be attached to each other in various ways. Preferably, however, the two layers are fabric welded, stitched or sewed together.

Figure 5:
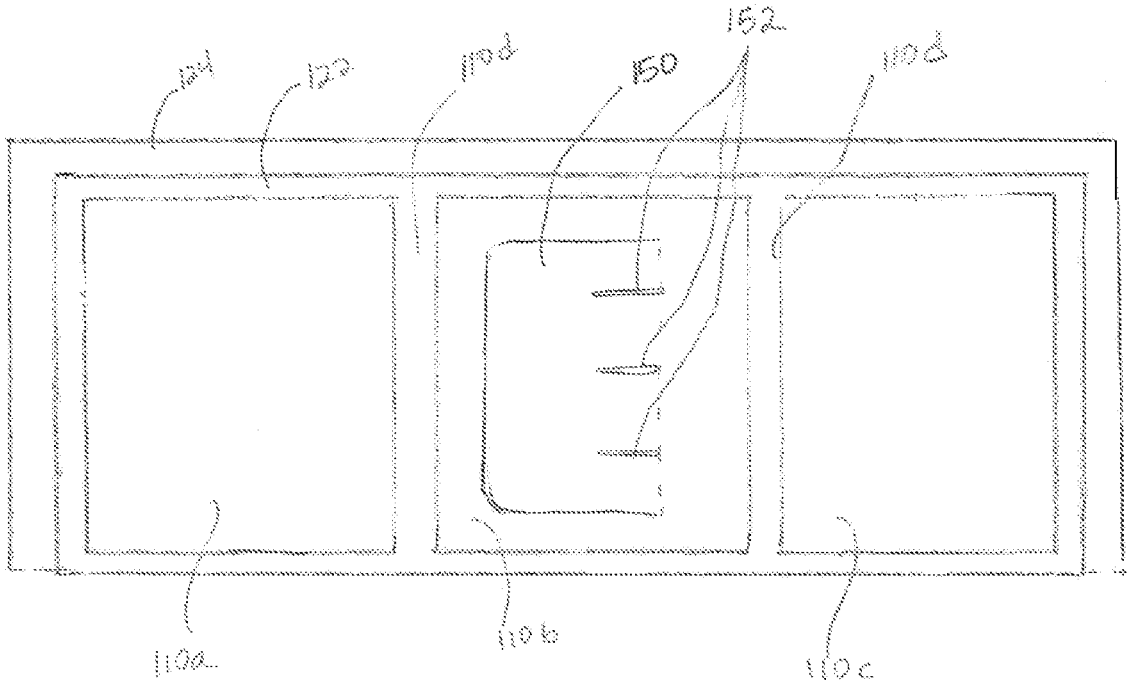
FIG. 5 illustrates an example of the present invention including a door.

FIG. 5 provides a further feature of the invention wherein a door 150 is provided on the curtain portion 110, to allow entry and exit without disassembling the inflatable ventilation life curtain 100. The door 150 can be closed with a zipper, Velcro, or other means to keep the door sealable closed when not in use. Further, the door may include straps and ties 152 in order to hold the door 150 back in an open position if needed.

Figure 6A:
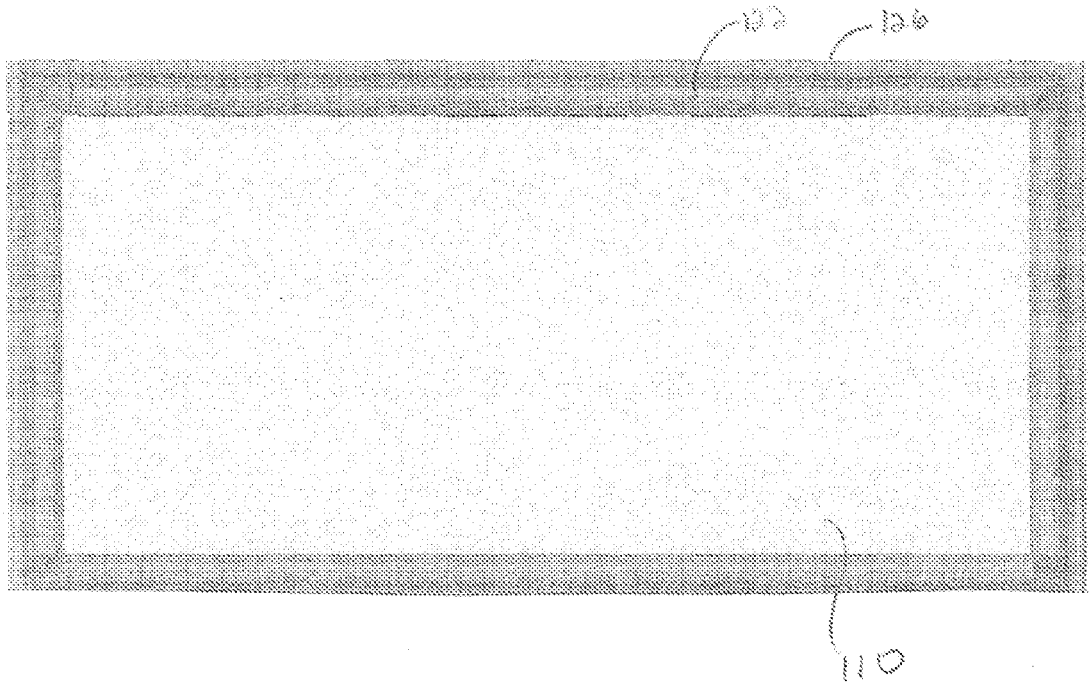
FIGS. 6A and 6B illustrate an alternative embodiment of the inflatable ventilation life curtain.
Figure 6B:
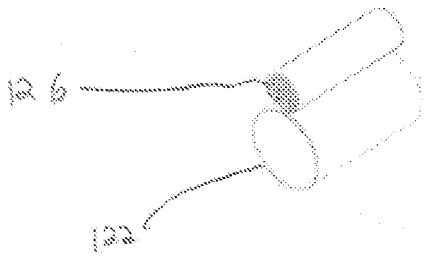

FIGS. 6A and 6B provide an alternative exemplary embodiment of the present invention. Here, an outer layer 126 of the inflatable portion 120 is foam filled instead of being inflated. The foam filled outer layer 126 may be pre-filled with foam before the inflatable ventilation life curtain 100 is brought on-site. In this alternative structure, this foam filled outer layer 126 may have a smaller cross-section than the gas filled inner layer 122.

The curtain portion may be made of any suitable coated nylon which is fire retardant, or other material possessing similar characteristics. Preferably, but not necessarily, the material of the inflatable ventilation life curtain should be leakproof and impermeable. Preferably, the inflatable ventilation life curtain will be made from Mine Safety and Health Administration (MSHA) approved ventilation curtain material, when the invention is to be used in a mining environment. Examples of materials suitable for the curtain portion are fire retardant coated nylon, neoprene and urethane. Likewise, the inflatable portion may also be made out of these types of materials.

The inflatable portion 120 may be integrally provided with the curtain portion 110. Alternatively, it may be stitched, welded or sewn to the curtain portion 110; moreover, the inflatable portion 120 and curtain portion 110 may be attached by other means which accomplish a secure attachment.

Moreover, in both exemplary embodiments, each of the inner and outer layers 122, 124 of the inflatable portion 120 may have more than one chamber (not shown). With this structure, if one of the chambers is compromised the inflatable ventilation life curtain will provide greater stability than if only one chamber is provided and compromised.

Now, a description will be provided for assembling the inflatable ventilation life curtain 100 for use. The following description refers to the use of the inflatable ventilation life curtain in a mine environment; however, this is merely an example and the curtain could be used in other places where ventilation diversion is required.

First, the inflatable ventilation life curtain 100 is stretched out in a desired location by a worker. Thereafter, means for raising the sides of curtain are assembled and used to raise the curtain. Such means for raising the curtain include pogo sticks, for example. The pogo sticks may be 2 inches in diameter, but the invention is not limited to such dimensions. The pogo sticks are preferably adjustable, but the invention is not limited to such characteristics.

Figure 7A:
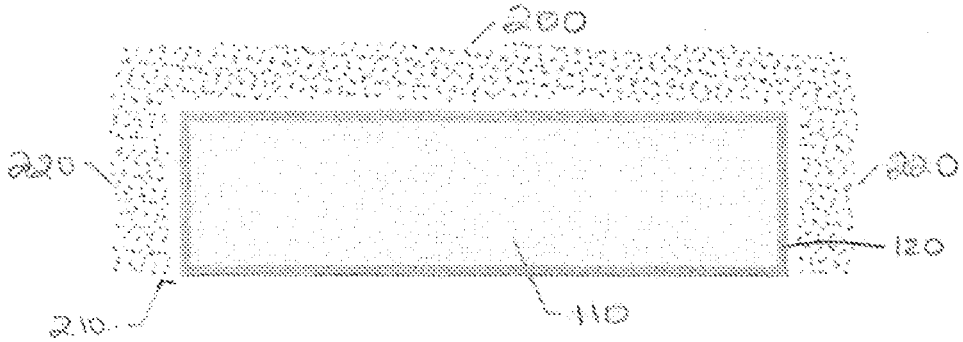
FIGS. 7A and 7B, respectively, illustrate the inflatable ventilation life curtain during inflation and after inflation is completed.
Figure 7B:
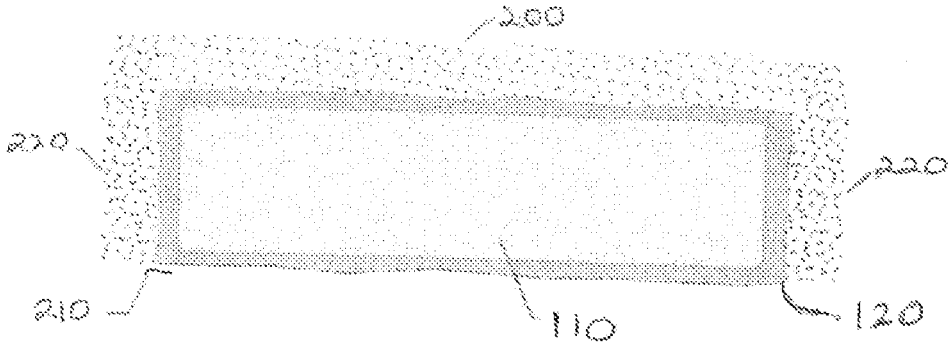

After the inflatable ventilation life curtain 100 is raised (see FIG. 7A), an inflating device, such as a carbon dioxide ($CO_2$) canister, or other inflation device, is connected to the inflate/deflate valve 130 (132) and the inner layer 122 is inflated. As the $CO_2$ container inflates the inner layer 122, these inflated areas begin to loosely abut against the roof 200, floor 210 and ribs 220 of the desired area in the mine. Since the perimeter of the inflatable ventilation life curtain is filled with air, it is flexible so that it can adapt to the configuration of the roof 200, floor 210 and ribs 220 of the mine. Once the inner layer 122 has completed inflated, the outer layer 124 (if it is an inflatable type) begins to inflate via the PRVs 140. As it expands due to the inflation, it pushes the inflatable ventilation life curtain 100 against the roof 200, floor 210 and ribs 220, to form a seal therewith, and thereby provides a temporary ventilation diversion for the workers situated within the barricaded area of the ventilation curtains. As shown in FIG. 7B, the inflatable portions 120 of the inflatable ventilation curtain 100 abut against the roof, floor and ribs, even when such surfaces are uneven, so as to provide a good seal.

Thus, the inflatable ventilation life curtain quickly and efficiently constructs a temporary ventilation diversion, while minimizing the use of construction material and labor.

Since the curtain is not inflated before use, it has a relatively flat configuration, and, thus, can be stored efficiently and is easily transportable. For instance, the inflatable ventilation curtain may be stored in a metal case, so that it can be easily transported to a desired location.

In addition to an emergency use, the ventilation curtain can be used in daily functions. It can be used as an air directional, for instance.

As mentioned above, a $CO_2$ canister is not required to inflate the inflatable ventilation life curtain. A hand pump or other inflating means may also be used to inflate the inflatable ventilation life curtain.

As mentioned above, the outer layer 126 may be foam filled rather than air filled. Moreover, the inner layer 122 may include portions 122*a* (e.g. support columns) strategically located at inner portions of the curtain portion 110, i.e., thereby the curtain portion is provided in multiple parts 110*a*, 110*b*, 110*c*. The support columns 122*a* provide increased strength and stability to the inflatable ventilation life curtain.

Still further, corner gussets can be provided for securing the corners of the inflatable portion, especially between the inner and outer layers.

Handles may also be provided along portions of the inflatable ventilation life curtain, such as along the inflatable portion, to facilitate handling of the device before inflation.

Still further, pogo pole straps may be provided at various locations of the inflatable ventilation life curtain, and preferably near the top sides, to facilitate use of the pogo sticks or other raising means before the device is inflated.

As mentioned above, the present invention provides a novel and improved apparatus and method for obtaining a temporary ventilation diversion. With the use of inflatable portions that are attached to a curtain, it is possible to achieve a good seal against uneven surfaces (e.g. roof, floors, ribs, etc.) so as to provide adequate air quality in the contained area. These inflatable portions may be inflated automatically, by use of a $CO_2$ canister, so that little labor is required by the user to construct the inflatable ventilation curtain. Such curtains are useful in barricading situations or for daily use where directional airflow is required.

Figure 8:
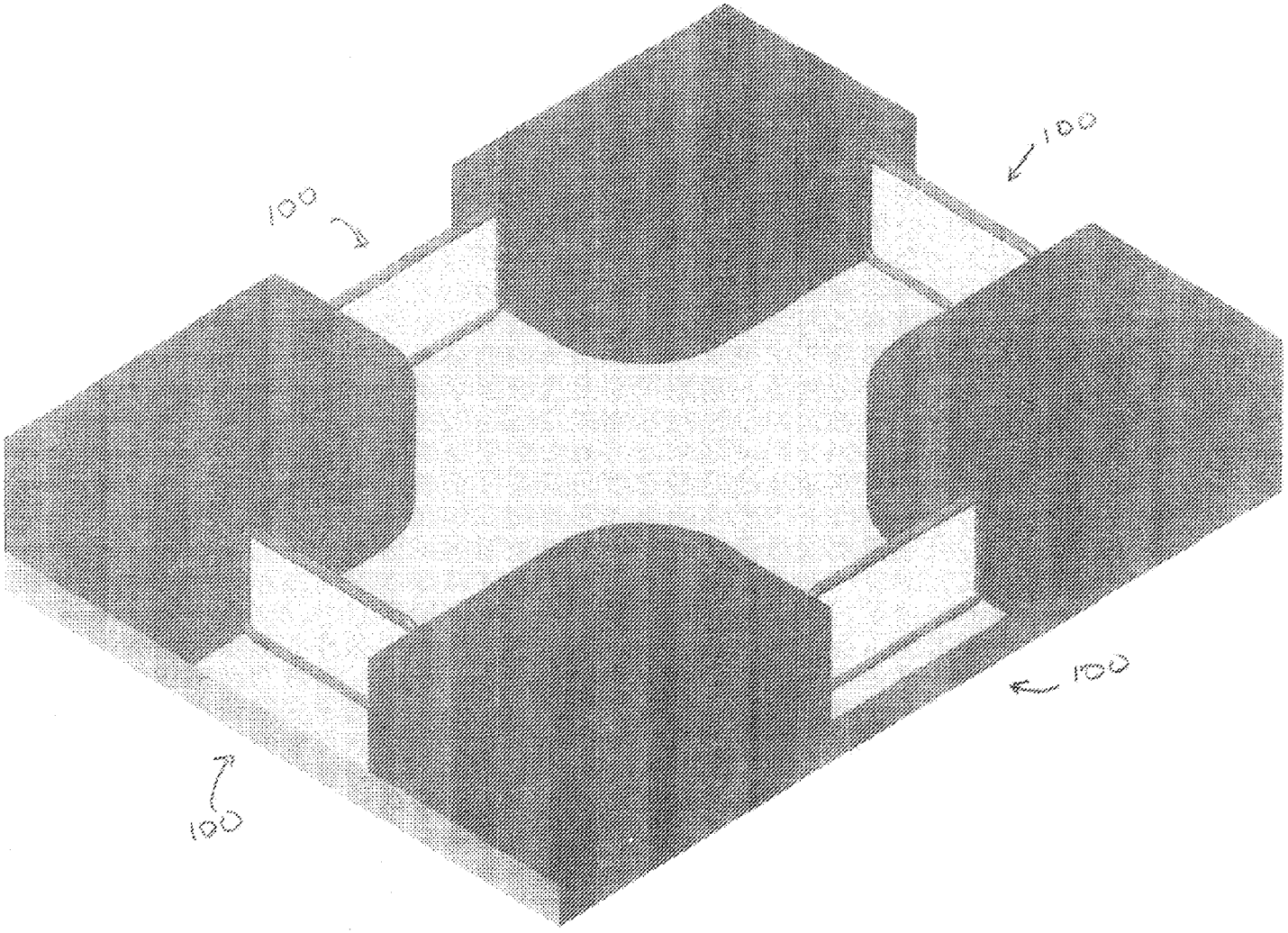
FIG. 8 illustrates a plurality of inflatable ventilation life curtains used for barricading.

As shown in FIG. 8, a plurality of inflatable ventilation life curtains 100 can be used to create a barricading.

While the present invention has been particularly shown and described with reference to exemplary embodiments thereof, it will be apparent to those skilled in the art that the scope of the invention is given by the appended claims, rather than the preceding description, and all variations and equivalents which fall within the range of the claims are intended to be embraced therein. Therefore, it should be understood that the above embodiments are not limitative, but illustrative in all aspects.

What is claimed is:

1. An inflatable ventilation curtain, comprising:

a curtain portion; and an inflatable portion provided around a perimeter of the curtain portion, wherein the inflatable portion includes an inflatable inner layer and an inflatable outer layer attached together, wherein the inflatable inner layer is provided immediately adjacent to an outer perimeter of the curtain portion so as to extend around the entire outer perimeter of the curtain portion, thereby imparting structural support to the curtain portion upon inflation of the inflatable inner layer, and wherein the inflatable outer layer is provided immediately adjacent to, and around at least a part of, an outer perimeter of the inflatable inner layer, wherein the inflatable inner layer and the inflatable outer layer are each gas inflatable, thereby providing two distinct inflatable areas, and wherein a valve is provided between the inflatable inner layer and the inflatable outer layer to facilitate the inflation of the inflatable outer layer via the inflatable inner layer.

2. The inflatable ventilation curtain according to claim 1, wherein the inflatable portion is integrally provided with the curtain portion.

3. The inflatable ventilation curtain according to claim 1, wherein, when inflated, the inflatable portion has a thicker width, as viewed in cross-section, than the curtain portion.

4. The inflatable ventilation curtain according to claim 1, wherein three valves are provided between the inflatable inner layer and the inflatable outer layer, at the top and sides of the inflatable inner layer.

5. The inflatable ventilation curtain according to claim 1, wherein the inflatable inner layer includes at least two inflatable support columns connecting the top and bottom sides of the inflatable inner layer, and substantially parallel with the sides of the inflatable inner layer, so as to divide the curtain portion into multiple parts having boundaries defined by the support columns, top and bottom sides of the inflatable inner layer.

6. The inflatable ventilation curtain according to claim 1, wherein an inflate/deflate valve is provided on the inflatable inner layer for inflating the inflating portion.

7. The inflatable ventilation curtain according to claim 1, wherein a door is provided on the curtain portion.

8. The inflatable ventilation curtain according to claim 1, wherein a plurality of inflatable ventilation curtains are provided to create a barricaded area.

9. A method of setting up an inflatable ventilation curtain which includes a curtain portion and an inflatable portion provided at a periphery of the curtain portion, comprising:

spreading out the inflatable ventilation curtain in a predetermined area, so that the curtain portion and the inflatable portion are spread out, wherein the inflatable portion has an inflatable inner layer and an inflatable outer layer;

after spreading out the inflatable ventilation curtain, raising sides of the inflatable ventilation curtain with raising means so that the inflatable ventilation curtain is raised up to an other predetermined area so as to be in an operative position for inflation; and after raising the sides, inflating the inflatable portion so that the inflatable portion imparts structural support to the inflatable ventilation curtain which is positioned in the other predetermined area, wherein the inflatable inner layer is a distinct inflatable area from the inflatable outer layer, and the inflatable inner layer is inflated before the inflatable outer layer begins to inflate, wherein the inflatable inner layer is provided immediately adjacent to the perimeter of the curtain portion and wherein the inflatable outer layer is provided around at least a part of an outer perimeter of the inflatable inner layer, wherein a valve is provided between the inflatable inner layer and the inflatable outer layer to facilitate the inflation of the inflatable outer layer via the inflatable inner layer.

10. The method of claim 9, wherein, when inflated, the inflatable portion has a thicker width, as viewed in cross-section, than the curtain portion.

11. The method of claim 9, wherein the inflatable inner layer includes inflatable support columns extending between top and bottom sides of the inflatable inner layer so as to divide the curtain portion into multiple parts having boundaries defined by the support columns, top and bottom sides of the inflatable inner layer, and wherein all portions of the inflatable inner layer including the support columns inflate at substantially the same time.

12. The inflatable ventilation curtain according to claim 1, wherein the inflatable ventilation curtain is portable.

13. The inflatable ventilation curtain according to claim 1, wherein the inflatable ventilation curtain seals a passage without being fixed to the passage.

* * * * *